US009572385B2

(12) United States Patent
Whitaker

(10) Patent No.: US 9,572,385 B2
(45) Date of Patent: Feb. 21, 2017

(54) BOWTIE CONSTRUCTION

(71) Applicant: Alexandra Whitaker, Rockville, MD (US)

(72) Inventor: Alexandra Whitaker, Rockville, MD (US)

( * ) Notice: Subject to any disclaimer, the term of this patent is extended or adjusted under 35 U.S.C. 154(b) by 0 days.

(21) Appl. No.: 14/580,516

(22) Filed: Dec. 23, 2014

(65) Prior Publication Data

US 2015/0173439 A1 Jun. 25, 2015

Related U.S. Application Data

(60) Provisional application No. 61/920,502, filed on Dec. 24, 2013.

(51) Int. Cl.
*A41D 25/02* (2006.01)

(52) U.S. Cl.
CPC ..... *A41D 25/02* (2013.01)

(58) Field of Classification Search
CPC ..... A41D 25/02
USPC ..... 2/148, 137, 151, 154, 156
See application file for complete search history.

(56) References Cited

U.S. PATENT DOCUMENTS 1,211,118 A * 1/1917 Ekstromer ..... A41D 25/003 2/145
1,481,539 A * 1/1924 Deiches ..... 2/154
1,800,729 A * 4/1931 Hodges ..... A41D 25/04 2/151
2,397,931 A * 4/1946 Ellis ..... A41F 1/002 135/119
2,849,721 A * 9/1958 Grontkowski ..... 2/151
3,022,515 A * 2/1962 Bornstein ..... A41D 25/02 2/151
3,728,737 A * 4/1973 Gillie ..... 2/151
4,021,891 A * 5/1977 Morita ..... 24/303
8,938,813 B2 * 1/2015 McDowell ..... 2/157
2006/0282993 A1 * 12/2006 Dietz ..... 24/303
2011/0219516 A1 * 9/2011 Pionessa ..... 2/145
2014/0101819 A1 * 4/2014 Ike ..... 2/145
2015/0052659 A1 * 2/2015 Talic ..... 2/156
2015/0216243 A1 * 8/2015 Graham ..... A41D 25/003 2/151

OTHER PUBLICATIONS

Bender, Tia. "Magnetic bowtie tutorial." taidye.original, Blogger, Apr. 28, 2011. Accessed: https://web.archive.org/web/20110907121832/http://taidyeoriginal.blogspot.com/2011/04/magnetic-bow-tie-tutorial.htm Internet Archieve date Sep. 7, 2011.*

* cited by examiner

*Primary Examiner* — Danny Worrell
(74) *Attorney, Agent, or Firm* — Ladas & Parry LLP

(57) ABSTRACT

A self-mounting bowtie has a pair of wings extending outwardly from a central wrapping band. A first magnetic element located at the wrapping band. A second magnetic element for magnetic attraction to the first magnetic element is provided to be positioned adjacent the central wrapping band with a layer of an article at a location at which the bowtie is to be attached being sandwiched between the central wrapping band and second magnetic element. The bowtie is thus magnetically retained at the desired location. The second magnetic element may be located on a fabric flap extending from the central wrapping element. Rare earth magnets, which provide a strong magnetic attraction despise a small size, are preferably used in the construction.

8 Claims, 3 Drawing Sheets

FIG. 5
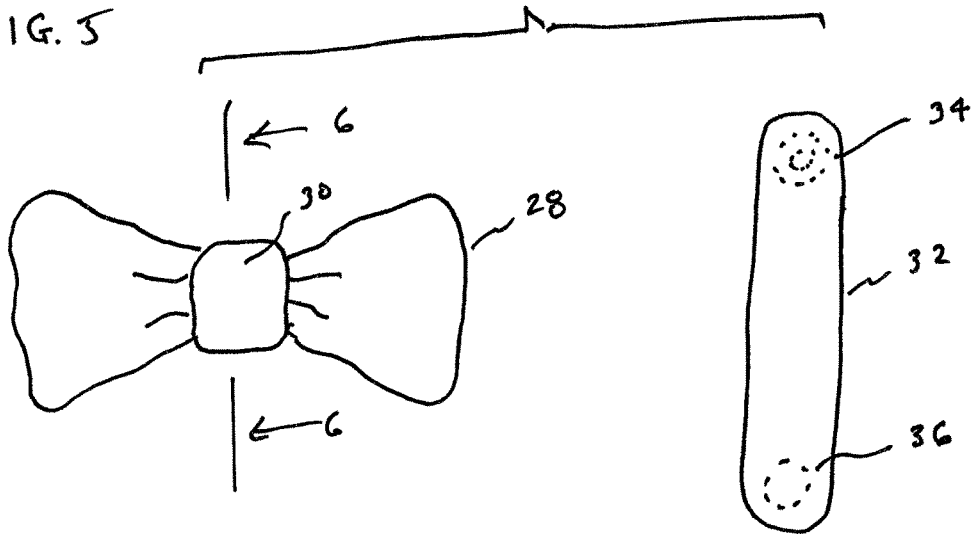
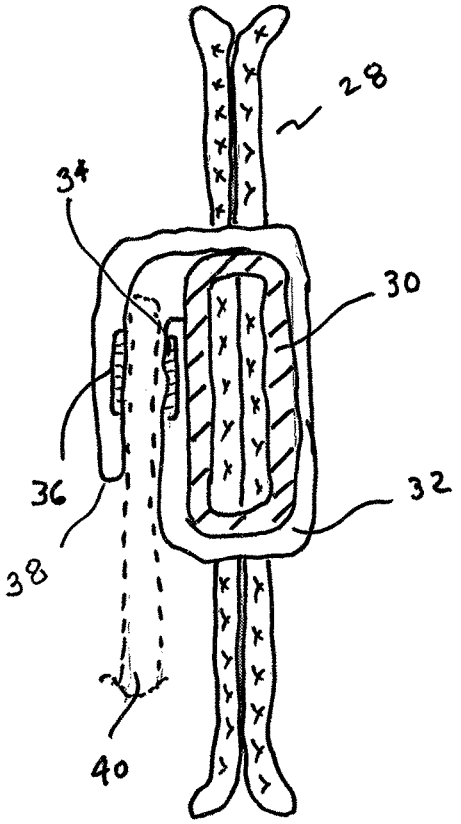
FIG. 6

BOWTIE CONSTRUCTION

The present invention relates to an item of clothing and in particular to a bowtie able to be affixed to an object, such as another article of clothing, in a simple and efficient manner.

BACKGROUND OF THE INVENTION

A bowtie has been a staple article of clothing for generations. Traditionally, the elongated fabric element for the bowtie must be wrapped around the upturned collar of the shirt with which it is to be worn and knotted by the wearer into its final form. This has always been a difficult procedure, requiring practice and dexterity by the wearer. To alleviate this difficulty, bowties are often sold in a pre-finished form, with the neck-encircling strap portion of the bowtie to be wrapped around the neck being divided into complementary portions which can be connected by the wearer through a button and buttonhole arrangement. The provision of several buttonholes allows the bowtie to be accommodated about different sized necks.

In addition to such a "wraparound" construction, bowties are also available with a mechanical clip-type of arrangement which engages the opposed forward edges of the collar. The two "wings" of the bowtie can be pivoted between a forward position, in which the clips are open for engagement with the collar, and a planar/wearing orientation, which engages the clip with the collar to maintain the bowtie in position.

While the above constructions allow a bowtie to be worn without the need for the complex tying maneuver, it would be of benefit to the tie-wearing population if a further, alternative method for mounting a pre-formed bowtie can be provided. Such a construction would advantageously allow a bowtie to be worn in connection with a variety of shirt and shirt collars, which might not otherwise reasonably accommodate other bowtie constructions, and would also allow a bowtie construction to be worn as a decorative or novelty item on other items of apparel and/or different locations on a shirt.

BRIEF DESCRIPTION OF THE INVENTION

In accordance with the foregoing and other objects and purposes, bowties constructed in accordance with the present invention include a pair of mutually attractive magnetic elements. In one embodiment, a first one of the elements is located within the tie, and preferably at the center point thereof, while the other element is either mounted to a flap attached to the bowtie or is free standing. The tie is mounted to an article of clothing either by positioning the bowtie at the desired position on an exterior surface of a clothing item and placing the free-standing magnet behind the tie and rear surface of the clothing item such that the mutual attraction between the two magnet elements draws them together in juxtaposition, retaining the tie in position. Alternatively, with a construction of the present invention in which the second magnetic element is located on a flap, the tie is toe placed in position proximate an edge of the item. The second element-bearing flap is folded over the item edge, whereby the two magnetic elements are in alignment to retain the tie in place. The latter construction can prevent against loss of the second magnetic element, and may also facilitate applying the tie to objects such as a belt or dog collar. It is to be recognized, of course, that the object to which the bowtie is to be mounted must be of a material and thickness that allows the first and second magnetic elements to be mutually attracted to each other through the object.

In a further embodiment the two magnetic elements are placed at opposed ends of an elongated flexible element. The flexible element is wrapped about the center of the bowtie such that one of the magnetic elements is at the rear of the tie. The flexible element is further wrapped about an edge of the clothing article to which to bowtie is to be affixed such that the second magnetic element, positioned behind the article edge, aligns with the first magnetic element and retains the bowtie in place.

BRIEF DESCRIPTION OF THE DRAWINGS

A fuller understanding of the present invention will be achieved upon consideration of the following detailed description of illustrative embodiments of the invention when they are reviewed in conjunction with the annexed drawings, wherein:

FIG. 5 is a front view of a further embodiment of the invention wherein the magnetic elements are located on a flexible element separate from the bowtie body;

FIG. 6 is an enlarged diagrammatic cross-sectional view of the embodiment of FIG. 5 taken along line 6-6 in FIG. 5 illustrating the wrapping of the flexible element about the tie and apparel to which the bowtie is to be affixed.

DETAILED DESCRIPTION OF THE INVENTION

Figure 1:
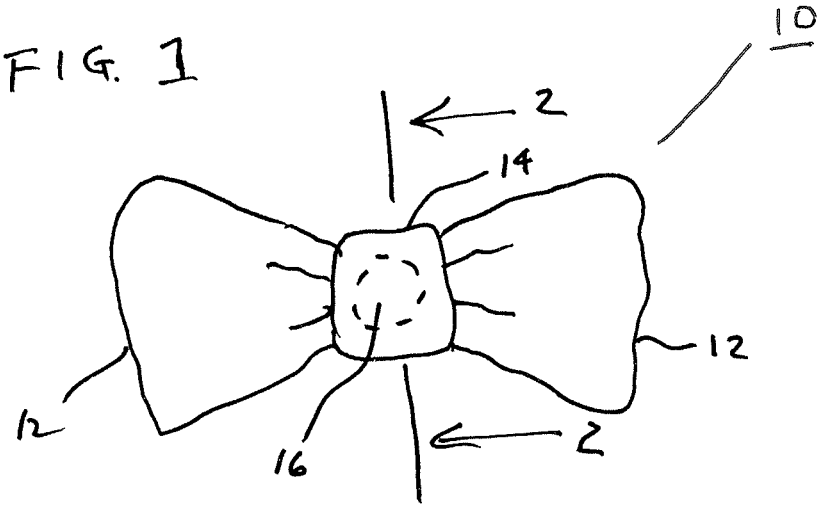
FIG. 1 is a rear view of a first embodiment of the invention.

As depicted in FIG. 1, bowtie 10 of the present invention is of generally conventional appearance, in which a pair of flaring opposed wings 12 are centrally pinched and overlaid by central wrapping band 14. While traditional "self-tied" bowties are constructed of a single length of fabric which is then tied by the wearer to create both the wings and central band, the present invention allows for the wings to be formed of a multilayered fabric element and the central wrapping band to comprise a separate fabric element, stitched or otherwise connected to the wings element to provide the traditional bowtie appearance. First magnetic element 16 is located either within or on a surface of the band, behind the pinched wings 12.

Figure 2:
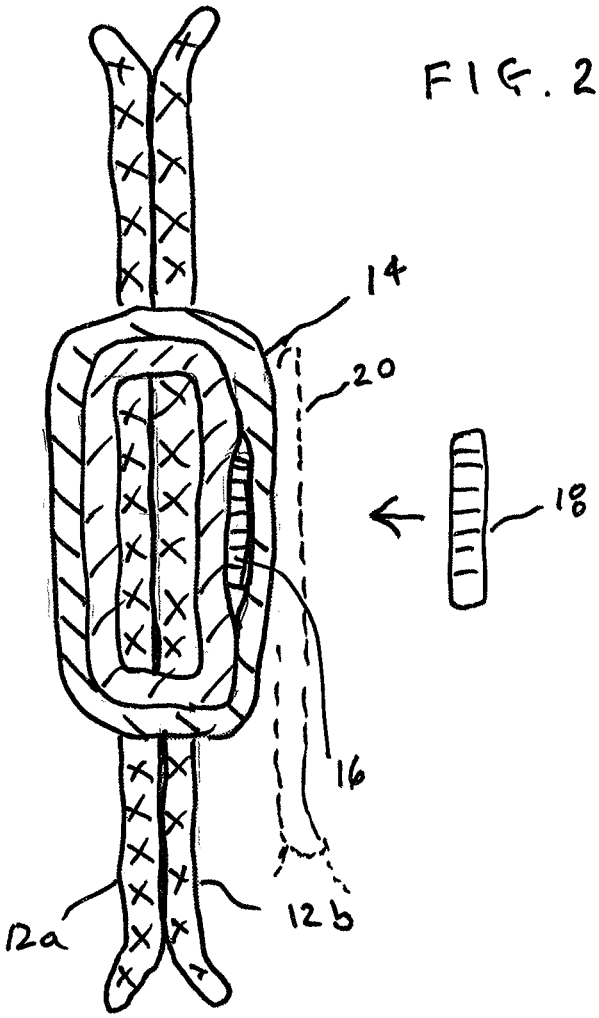
FIG. 2 is an enlarged cross-sectional view of the bowtie of FIG. 1 taken along line 2-2 in FIG. 1, the view also showing the alignment of the two magnetic elements.

FIG. 2, an enlarged diagrammatic section view of the bowtie in elevation, illustrates that the central band 14 may be in the form of a flat tube in which the magnetic element 16 is located. Stitching about the periphery of the magnetic element can maintain the element in position. This view also illustrates that the bowtie wings 12 may be formed of a multiple layers 12 *a, b* of material, as known in the art. Magnetic element 16 may preferably be a "rare earth" magnet, which, despite small size, provides an intense magnetic field. The magnetic element 16, which may be a rare earth "button" magnet with a diameter in the range of a half inch, is placed within the band 14 and the band is then wrapped around and affixed to the wing fabric, such as by stitching, with the enclosed magnet being positioned at the back of the tie, to lie closest to the clothing item, such as a shirt neck, a portion of which is shown in phantom at 20, to which the tie is to be mounted. Both the band and wings may be fashioned of any appropriate material, typically a fabric such as silk, silk blends, cotton or a synthetic. The fabric may have any appropriate design, such as a plaid, or may be of a single color, such as black.

To affix the tie in position, second magnetic element 18 is placed adjacent the rear surface of the garment element where the bowtie is to be placed, and the bowtie positioned such that the first magnetic element 16 aligns with the second magnetic element 18. The magnetic force between the two elements attracts them together, providing a strong retention force for the bowtie on the garment at the desired place. To maximize the holding force the second magnetic element 18 is likewise preferably a rare earth magnet, which may be encased in a fabric or rubber casing to provide a less obtrusive appearance and to provide a more easily gripped surface, although it is to be appreciated that either one of the magnetic elements may be of a magnetically-attracted material, such as iron, while the other element is preferably a rare earth magnet. When it is desired to remove the bowtie, manual action to separate the magnetic elements from each other, overcoming the magnetic force, accomplishes removal. The tie and second magnetic element can then be put away for subsequent use. Those skilled in the art will readily appreciate that the polarities of the magnetic elements must be respected as required so that they are properly oriented with respect to each other to attract, rather than repel, each other.

Figure 3:
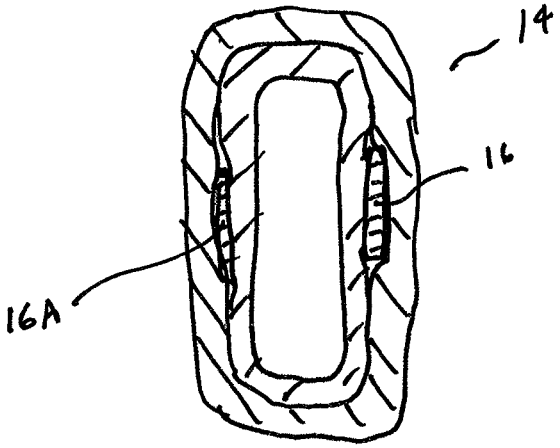
FIG. 3 is a view similar to that of FIG. 2, showing an embodiment of the invention in which a pair of magnetic elements are located in the bowtie.

An alternative embodiment of the invention provides a pair of magnetic elements in the central wrapping band 14 of the bowtie. As depicted in FIG. 3, a further tie-mounted magnetic element 16A is located in the band 14 on the opposite side of the wings (not shown). This allows the bowtie to be mounted to the garment with either side facing out. If the wings of the tie are of multiple layers, with the front layer having a different design from the rear layer, rotating the tie between the two alternative orientations allow the alternative designs to be displayed. Preferably both magnetic elements 16 and 16A are magnets, which should be aligned in the band such that complementary poles of the magnets face each other, drawing the band about the wings and providing a compact structure. Orienting the magnets with the same poles facing in each other will generate a repulsive force between them, making assembly of the tie difficult and causing the band to bulge, creating an unattractive appearance.

Figure 4:
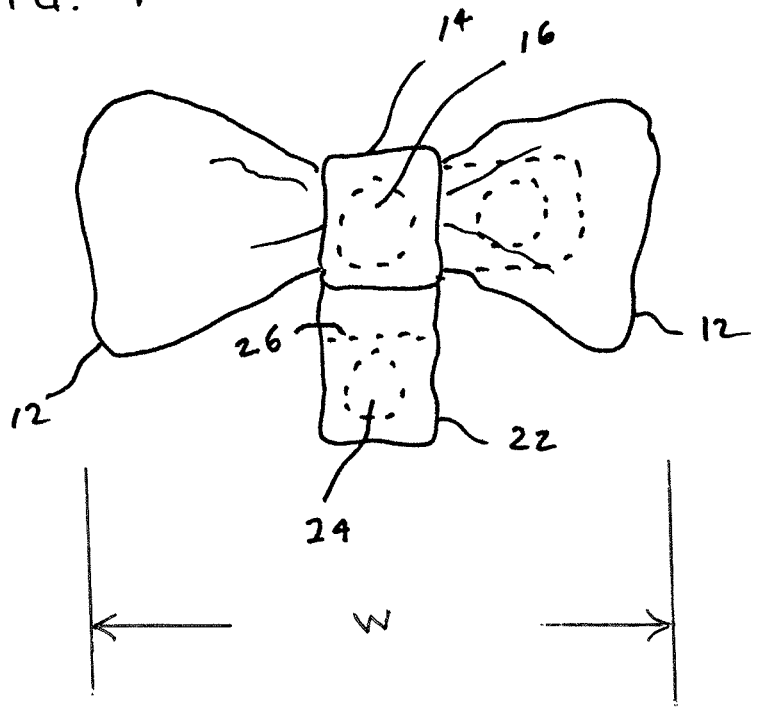
FIG. 4 is a rear view of an embodiment of the invention in which a second magnetic element is located on a flap.

FIG. 4 presents a further embodiment of the invention. In this embodiment the closed loop central wrapping band 14 is provided with a flap or tab portion 22. A second magnetic element 24 is enclosed within the flap, and may be maintained in place by a line of cross stitching 26. This construction allow the bowtie 10 to be attached to narrow items, like a belt or dog collar, by wrapping the flap around the item and engaging the enclosed magnetic element 22 with magnetic element 16. Alternatively, the construction can be used where the bowtie is placed on an object's surface sufficiently close to an edge, such as a shirt collar or cuff, such that the magnetic element in the flap can be positioned on the opposite surface in the same manner as the free magnetic element 18 of the embodiment of FIG. 1. The length of the flap may be chosen in consideration of the required positioning of the magnetic element 24 opposite the element 16. Incorporation of the magnetic element 24 in the flap 22 helps ensure that the magnetic element is not misplaced during storage, as may be the free magnetic element 18. The flap may extend either at a right angle to the width of the tie, as shown at 22, or may be positioned parallel to the width of the tie, as depicted in phantom in the figure depending of the intended orientation of the bowtie with respect to the object to which it is attached.

FIGS. 5 and 6 present yet another embodiment of the invention. As depicted, this embodiment comprises bowtie 28, which is of generally conventional construction with wings projecting outwardly from pinched center 30. A separate wrapping band 32, constructed of a complementary fabric, carries enclosed magnetic elements 34 and 36 at its distal ends. The wrapping band is first wrapped about the pinched center 30 of the bowtie, with the magnetic element 34 positioned at the rear of the bowtie, as depicted in FIG. 6. The wearer then wraps the free distal end 38 over an edge of the apparel item 40 to which the bowtie is to be affixed, aligning the two magnetic elements to hold the bowtie in position. The magnetic elements are positioned in the wrapping band such that they attract, rather than repel, each other when the bowtie is put in place.

As further depicted in FIG. 5, the magnetic element 34 may be donut or ring shaped, allowing it to be aligned with and encircle a button on the apparel item, such as a neck button on a dress shirt 40, to both help align the bowtie on the apparel and maintain it in position. Rare earth magnets, in particular, are available in a variety of sizes and central opening diameters. Such a magnet can also be used in any of the other embodiments of the invention.

Those skilled in the art may appreciate that other modifications and adaptations of the invention as disclosed herein may be achieved without departing from the intended scope of the invention.

I claim:

1. A bowtie, comprising a pair of wings extending outwardly from a central closed loop wrapping band; a first magnetic element located at the wrapping band, a second magnetic element for magnetic attraction to the first magnetic element, and a flap extending from the closed loop central wrapping band with a single free end displaced from the wrapping band dimensioned and positioned for wrapping about an edge of a shirt with the bowtie at a desired attachment location proximate the shirt edge, the second magnetic element being mounted to the free end of the flap, the flap being of a length to position the second magnetic element behind a layer of the shirt proximate the edge of the shirt in juxtaposition with the first magnetic element and be magnetically attracted thereto with the shirt layer between the two magnetic elements and the bowtie in the desired attachment location at the shirt in front of and against the shirt layer, whereby the bowtie is magnetically retained at the attachment location.

2. The bowtie of claim 1, wherein the first magnetic element is located within the central wrapping band.

3. The bowtie of claim 1, wherein the flap extends parallel to a width of the bowtie.

4. The bowtie of claim 1, wherein the flap extends perpendicular to a width of the bowtie.

5. The bowtie of claim 1, wherein at least one of the first and second magnetic elements is a rare earth magnet.

6. The bowtie of claim 1, wherein the first magnetic element is ring shaped.

7. A shirt and bowtie construction, comprising a shirt with a neck area, the bowtie being located and positioned upon an outer surface of a shirt layer at the shirt neck, the bowtie comprising a pair of wings extending outwardly from a central closed loop wrapping band; a first magnetic element located at the wrapping band, and a second magnetic element for magnetic attraction to the first magnetic element, and a flap extending from the closed loop central wrapping band and wrapped about a neck edge of the shirt, the second magnetic element being mounted to a distal end of the flap, the flap being of a length whereby the second magnetic element is positioned upon an inner surface of the shirt layer in juxtaposition with the first magnetic element and magnetically attracted thereto, whereby the bowtie is maintained in position by the magnetic attraction between the first and second magnetic elements.

8. The bowtie of claim 1, wherein the flap has a first end located at the wrapping band, the first magnetic element being mounted to the flap first end, the first magnetic element having a central opening sized to embrace a button whereby the bowtie can be located to overlie the button at the location at which the bowtie is to be attached.

* * * * *